United States Patent [19]

Furukawa

[11] Patent Number: 4,869,050

[45] Date of Patent: Sep. 26, 1989

[54] VACUUM PACKAGING APPARATUS

[75] Inventor: Takao Furukawa, Onomichi, Japan

[73] Assignee: ECS Corporation, Japan

[21] Appl. No.: 218,967

[22] Filed: Jul. 14, 1988

[30] Foreign Application Priority Data

Feb. 12, 1988 [JP] Japan ..... 63-31615

[51] Int. Cl.[4] ..... B65B 31/02

[52] U.S. Cl. ..... 53/510; 53/432

[58] Field of Search ..... 53/86, 91, 92, 93, 95, 53/96, 101, 102, 512, 434, 432, 510

[56] References Cited

U.S. PATENT DOCUMENTS 2,924,922 2/1960 Burnett ..... 53/512 X 2,933,868 4/1960 Graefingholt ..... 53/512 X

*Primary Examiner*—John Sipos

*Assistant Examiner*—Beth Bianca

*Attorney, Agent, or Firm*—Barnes, Kisselle, Raisch, Choate, Whittemore & Hulbert

[57] ABSTRACT

The invention relates to a method for vacuum-packaging bags filled with articles and to an apparatus therefor. Such packaging bag is stored in a chamber and a vacuum is applied to the interior of the chamber; the opening edge of the packaging bag is sealed. Such chambers are suspendedly supported on a rotor rotating around a horizontal axis. The chambers are rotated with the rotor along a circular path in a vertical plane. At this time, the component force acting on a packaging bag is smaller than in the case where the chambers are rotated along a circular path in a horizontal plane. As a result, deviation of packaging bags is prevented.

4 Claims, 3 Drawing Sheets

VACUUM PACKAGING APPARATUS

FIELD OF THE INVENTION

The present invention relates to a vacuum packaging method and an apparatus therefor using a plurality of pressure resisting chambers adapted to be rotated along an endless path, the arrangement being such that during the time each chamber makes one revolution along said endless path, a commodity is vacuum-packaged in said chamber.

BACKGROUND OF THE INVENTION

In a conventional vacuum packaging method using pressure resisting chambers adapted to be rotated along an endless path, an apparatus is used wherein said pressure resisting chambers are rotated around the axis of a center shaft supported so that its axis is vertical, and a packaging bag containing an article is charged into each pressure resisting chamber when the latter is split in two, whereupon said chamber is closed and a vacuum is formed therein during rotation (refer, for example, to Japanese Patent Application Laid-Open Specification No. 62-182014).

However, the conventional pressure resisting chamber comprises a flat disk for placing a packaging bag containing an article thereon and an inverted cup-shaped cover member; the packaging bag tends to be deviated on the disk by the centrifugal force produced therein when the chamber is being rotated in a horizontal plane. Particularly in the type in which chambers are intermittently rotated in a horizontal plane while repeating alternate start and stop, deviation tends to occur in the packaging bags the more frequently; thus, it has been impossible to rotate the chambers at high speed.

DISCLOSURE OF THE INVENTION

With the above in mind, the invention has for its object the provision of a vacuum packaging method wherein chambers are rotated in a direction in which deviation of packaging bags does not take place.

To achieve this object, a method for vacuum-packaging bags containing articles therein according to the invention comprises the steps of:

suspendingly supporting a plurality of open-and-close type chambers at regular intervals along the peripheral edge of a rotor rotatable in a vertical plane around a horizontal axis, and rotating said chambers with said rotor around said axis, opening said chambers in the lower region of a rotary circular path for said chambers, and storing a packaging bag filled with an article therein in each chamber through the thus defined opening in the chamber, during the time said chamber rotates around said axis with said storing position counted as the starting point, performing the sub-steps of:

- forming a vacuum in each chamber after the chamber opening has been air-tightly closed,
- sealing the opening edge of the packaging bag in the chamber, and
- taking out the packaged article from the chamber when the latter returns to the lower region of the rotary circular path and is opened with the vacuum therein removed.

According to the invention, as described above, a plurality of chambers are rotated with the rotor around a horizontal axis. Since the chambers are suspendedly supported on the peripheral edge of the rotor, each chamber is always directed in the same direction at any position on the rotary path. Therefore, the opening in the chamber always faces in the same direction, with the result that a packaging bag can be accommodated in the chamber easily and mechanically.

Each chamber receives a packaging bag in the lower region of the rotary circular path and begins to rotate around the axis with this location as the starting point. The starting point can be determined so that the direction in which the chamber begins to rotate is an obliquely upward. At said starting point, since the force on the chamber acts obliquely upward, frictional force between the lower surface of the packaging bag received in the chamber and the chamber increases, preventing deviation of the packaging bag.

The chambers rotating along the circular path move from the lower region to the upper region of the circular path and then from the upper region to the lower region. At this time, a force tending to raise the packaging bag begins to act. However, since the opening edge of the packaging bag has been clamped by seal bars and subjected to the sealing action, there would be no adverse effects whatever even if the packaging bag should deviate sideward.

According to the invention, since deviation of the packaging bags is prevented by rotating the chambers with packaging bags received therein around a horizontal axis, it is possible to increase the rotative speed of the chambers and the rotor and to thereby increase efficiency. Since the rotation of the chambers is effected in a vertical plane, as opposed to the conventional method in which they are rotated in a horizontal plane, there is an advantage that the space for installation of the apparatus for working the present method can be reduced in horizontal dimension.

DESCRIPTION OF THE EMBODIMENTS

First Embodiment

Figure 1:
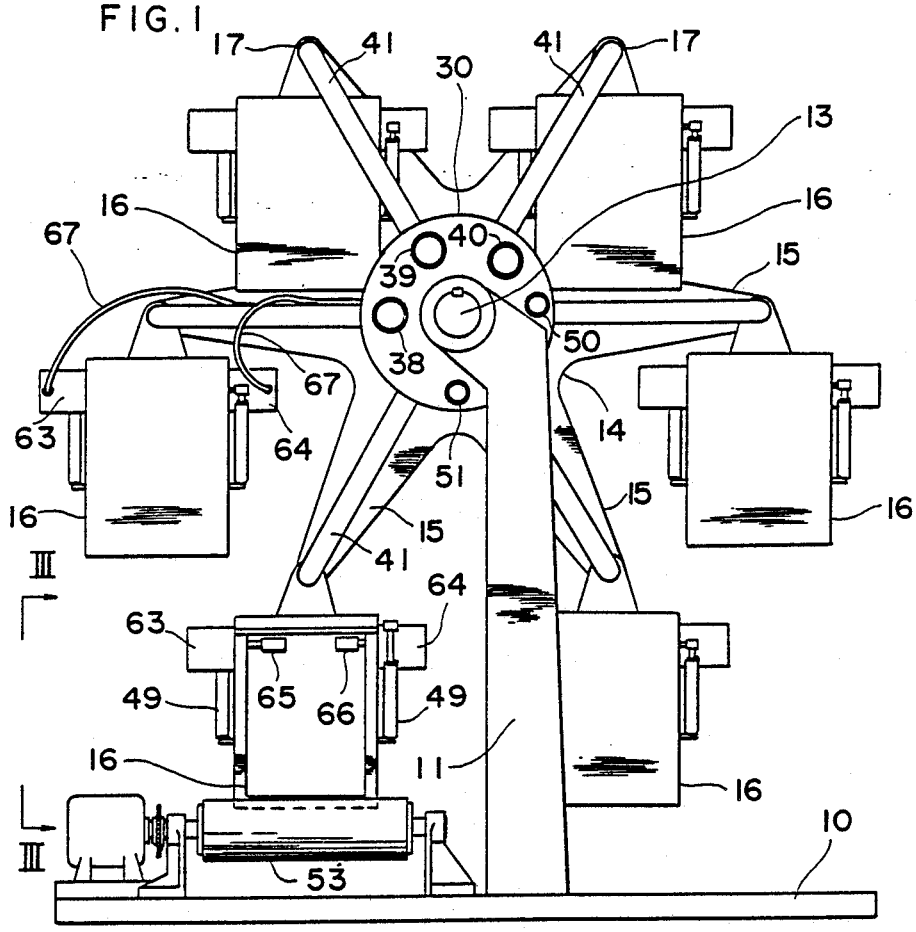
FIG. 1 is a plan view of a vacuum packaging apparatus according to a first embodiment of the invention.
Figure 2:
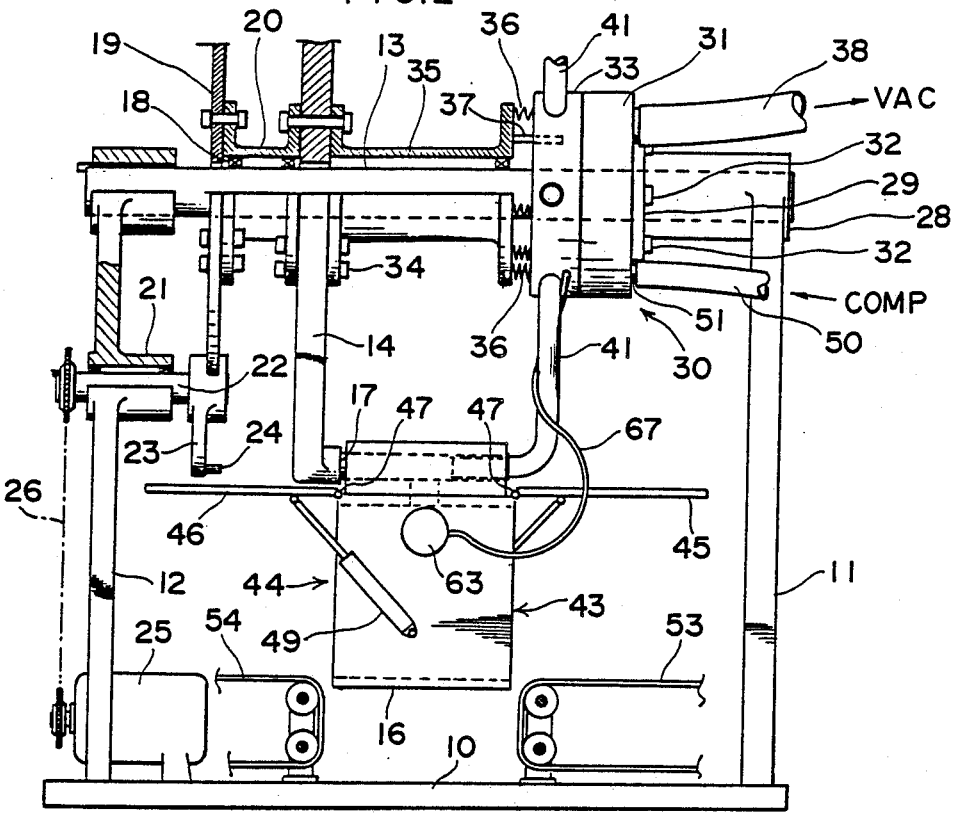
FIG. 2 is a side view of the apparatus of FIG. 1.
Figure 3:
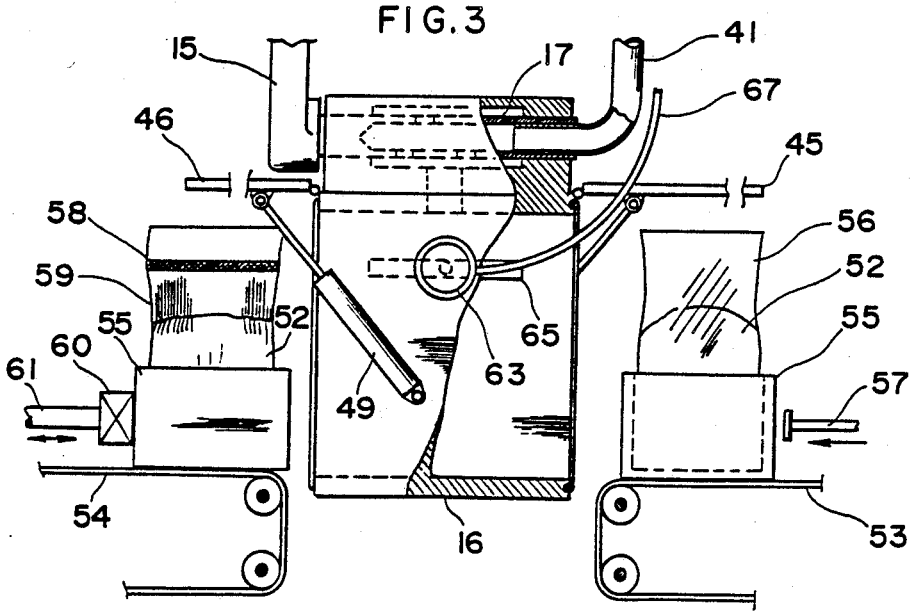
FIG. 3 is a view taken in the direction of arrows III—III in FIG. 1.

As shown in FIGS. 1 and 2, a center shaft 13 is horizontally installed between the upper ends of two columns erected on a seat plate 10 and the center shaft 13 rotatably supports a rotor 14. Said rotor 14 has six arms 15 radially extending from the peripheral edge thereof, with chambers 16 turnably suspended at their upper surfaces from the ends of said arms 15 by pins 17. On the other hand, a Geneva wheel 19 is supported on said center shaft 13 through a ball bearing 18 and is fixed to said rotor 14 through a cylindrical connecting member 20. An arm 23 is attached to one end of a shaft 22 supported in a bearing 21 formed in an intermediate portion of the column 12, said arm 23 having a pin 24 fixed to the end thereof. Further, a power source 25 and said shaft 22 are interconnected by a chain 26.

As the power from the power source 25 is transmitted through the chain 26 to the shaft 22 to rotate the latter, the pin 24 intermittently engages with the Geneva wheel 19, so that the rotor 14 is rotated with the chambers 16 around the axis of the center shaft 13. In FIG. 1, the chambers 16 are intermittently rotated clockwise each time by an amount equal to the pitch with which the chambers 16 are spaced apart from each other.

In FIG. 2, a fixed plate 31 on one side of a rotary valve 30 is fixed by screws 32 to a flange 29 formed on the end of a bearing 28 formed on the upper end of the column 11 at one side, and there is installed a movable disk 33 for surface contact with said fixed disk 31. Around the center shaft 13, a plurality of pressure springs 36 are interposed between a cylindrical support member 35 fixed to the rotor 14 by screws 34 and said movable disk 33, said springs 36 pressing said movable disk 33 against the fixed plate 31 to effect surface contact therebetween. A pin 37 projecting from the support member 35 is engaged with the movable disk 33. As a result, the rotative power from the rotor 14 is transmitted to the movable disk 33 through the pin 37, so that the movable disk 33 is rotated in contact with the fixed plate 31.

Three pipes 38, 39 and 40 connected to the fixed disk 31 are respectively connected to vacuum pumps, while six pipes 41 connected at one of their respective ends to the peripheral surface of the movable disk 33 are connected at the other ends thereof to the ends of the pins 17, thereby establishing the communication between the pipes 41 and the chambers 16 through the hollow portions of the pins 17. As a result, a vacuum acts only in the interior of the chambers 16 communicating with the three pipes 38, 39 and 40 through the rotary valve 30.

The chambers 16 open at the front and rear directed at right angles to the rotary circular path, and each chamber 16 has a front open surface 43 and a rear open surface 44 which are openably closed by cover members 45 and 46 attached to the chamber 16 by hinges 47. Further, the lateral edges of the two cover members 45 and 46 are connected to the lateral surfaces of the chamber 16 by air cylinders 49, 49. The rotary valve 30 is connected to a compressor (not shown) through an air inlet opening 51 formed in the rotary valve 30 a pipe 50. As a result, when the six chambers 16 rotating integrally with the rotor 14 along the circular path reach the lower region of the circular path, air flows into the chamber through the air inlet opening 51 while compressed air is applied to the two air cylinders 49, 49 to open the two cover members 45 and 46.

At the front and rear of the location where the cover members 45 and 46 are opened and the chambers 16 are stopped, there are installed a feed conveyor 53 and a carry-out conveyor 54. When the chamber 16 having its cover members 45 and 46 opened stops between these conveyors 53 and 54, a packaging bag 56 erected in a metal container 55 and having an article 52 contained therein is moved to the inlet of the chamber 16 by the feed conveyor 53, and the packaging bag 56 with the container 55 is fed into the chamber 16 by a push rod 57.

When the packaging bag 56 with the article 52 filled therein is fed, together with the metal container 55, into the chamber 16, the chamber 16 begins to rotate along the circular path. Simultaneously therewith, the opening surfaces of the chamber 16 are air-tightly closed by the cover members 45 and 46 and a vacuum is formed therein. Two actuators 63 and 64 disposed on opposite sides of each chamber 16 are connected to two seal bars 65 and 66 disposed in the chamber by piston rods. The actuators 63 and 64 are connected to the rotary valve through tubes 67. Thus, when the degree of vacuum in the chamber 16 increases, compressed air is fed to the actuators 63 and 64 and the opening in the bag 56 is clamped and heat-sealed by the two seal bars 65 and 66, whereby a packaged product 59 is obtained.

When the chamber 16 is rotated through one revolution along the circular path to return to the position opposed to the carry-out conveyor 54 and when the cover members 45 and 46 are opened, the packaged product 59 is taken out of this chamber 16 before a new packaging bag 56 is fed. At this time, the metal container 55 is attracted by a pull-out rod 61 having an electromagnet 60 mounted on the front end thereof. The metal container 55 and the packaged product 59 are taken out of the chamber and placed on the carry-out conveyor 54, whereby they are carried out.

Second Embodiment

Figure 5:
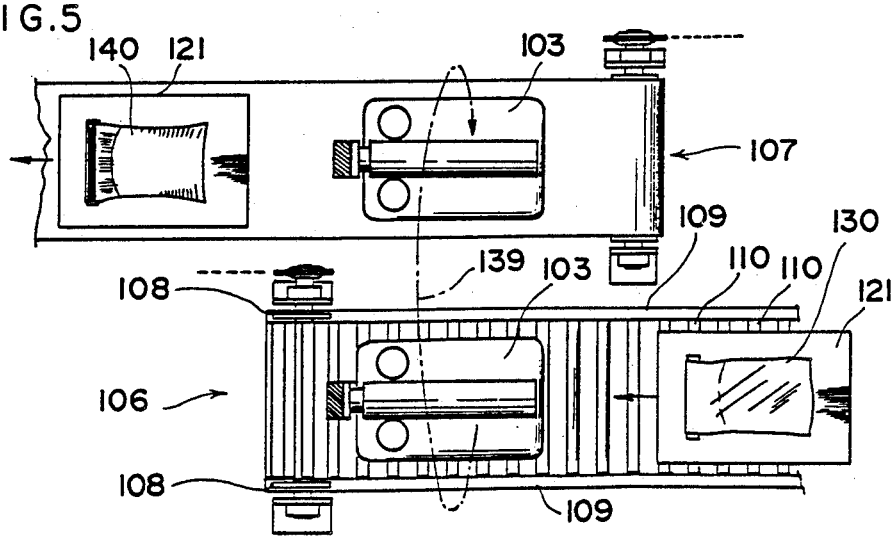
FIG. 5 is a view taken in the direction of arrows V—V in FIG. 4.
Figure 4:
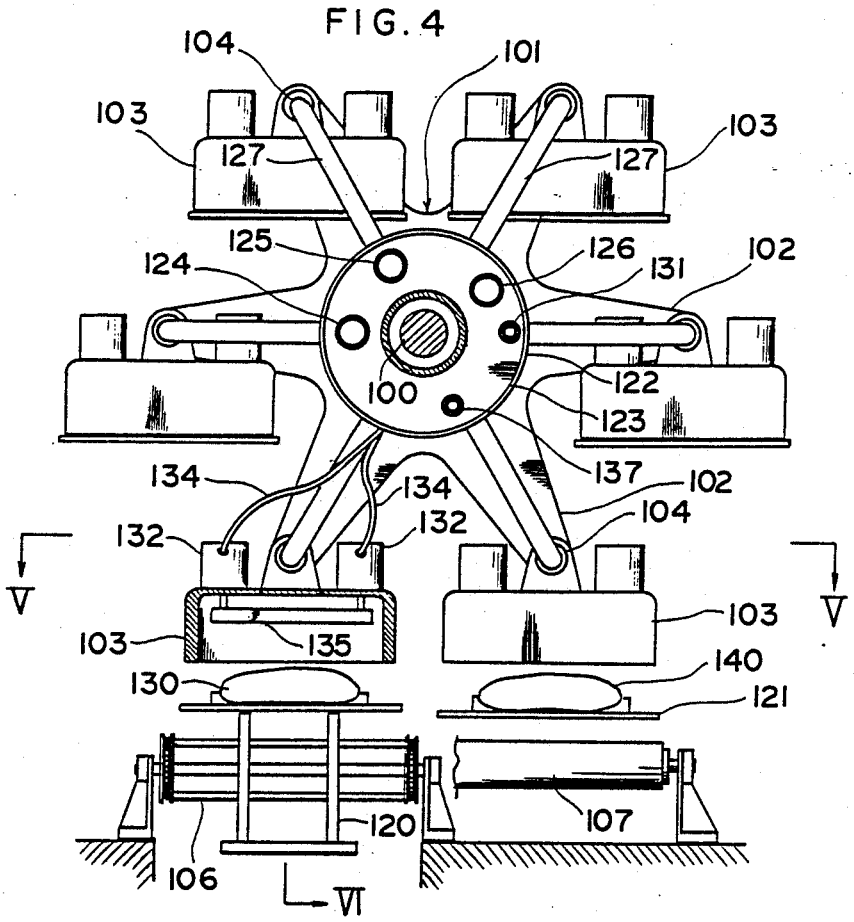
FIG. 4 is a front view of a vacuum packaging apparatus according to a second embodiment of the invention.
Figure 6:
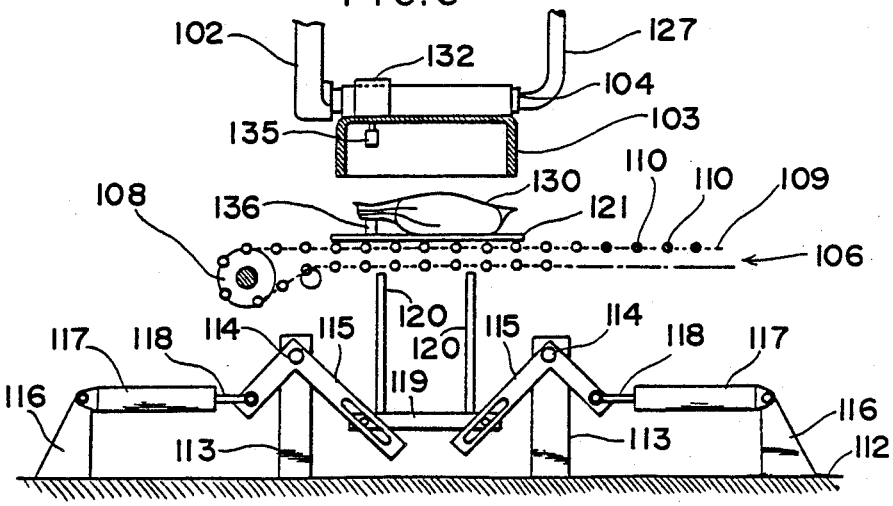
FIG. 6 is a view taken in the direction of arrows VI in FIG. 4.

This embodiment is shown in FIGS. 4 through 6. As compared with the first embodiment, this embodiment differs therefrom in that the opening surfaces of the chambers are directed downward to receive packaging bags from below; there is not much difference in the rest of the arrangement.

In FIG. 4, a center shaft 100 is fixed at its opposite ends to the machine frame and thereby horizontally supported. A rotor 101 is rotatably supported on said center shaft 100. Six arms 102 radially extend from the peripheral edge of the rotor 101, and chambers 103 are suspendedly supported at the ends of said arms 102 by pins 104. The rotor 101 is connected to a power source through a Geneva mechanism, so that the rotor 101, suspending the chambers 103, is intermittently rotated with the same pitch as the installation spacing between the chambers 103.

The chambers 103 are inverted cup-shaped with their lower surfaces opened, and a feed conveyor 106 and a carry-out conveyor 107 are installed in parallel to each other below the lower region of a rotary circular path along which the chambers 103 are rotated with the rotor 101. The feed conveyor 106 is formed of a number of bars 110 extending between opposed chains 109 entrained around chain wheels 108. As shown in FIG. 6, levers 115 are rotatably supported by pins 114 on two supporters 113 erected on a seat plate 112 below the feed conveyor 106. Two air cylinders 117 installed on seat plates 112 through brackets 116 are connected to the two levers 115, each at one end thereof, by piston rods 118. A plurality of push-up rods 120 are erected on the upper surface of a supporter plate 119 supported between the other ends of the two levers 115, so that the push-up rods 120 can pass between adjacent rods 110 of the feed conveyor 106.

When a chamber 103 conveyed by the rotor 101 stops above the feed conveyor 106, the levers 115 are swung around the axes of the pins 114 by the air cylinders 117, thereby raising the push-up rods 120. As a result, a disk 121 which has been conveyed by the feed conveyor 106 to a place below the chamber 103 is raised by the push-up rods 120 until it contacts the lower surface of the chamber 103.

In FIG. 4, a rotary valve 122 disposed around the center shaft 100 comprises a movable disk (not shown) rotatable integrally with the rotor 101 and a fixed disk 123 which is positioned in sliding contact relation to said movable disk. Three pipes 124, 125 and 126 connected to the fixed disk 123 are connected to vacuum pumps, while six hoses 127 connected at one of their respective ends to the movable disk are connected at the other of their respective ends to the six chambers 103.

As shown in FIG. 6, it is arranged that a chamber 103 arriving above the feed conveyor 106 begins to form a little of a vacuum through the hose 127. Thus, the disk 121 raised by the push-up rods 120 is attracted to the open surface of the lower side of the chamber 103. Thereafter, when the rotor 101 begins to rotate, the chambers 103 in communication with the three pipes 124, 125 and 126 are evacuated. As the six chambers 103 are successively stopped above the feed conveyor 106, disks 121 each having a packaging bag 130 placed thereon are successively attracted to the lower surfaces of the chambers 103. As the chambers 103 are rotating along the circular path while holding the respective disks 121 by vacuum suction force, the article in each packaging bag 130 is subjected to a vacuum.

A compressor is connected to the fixed disk 123 of the rotary valve 122 through a pipe 131. Actuators 132 installed on the upper surface of each chamber 103 are connected to the movable disk of the rotary valve 122 through tubes 134. When the degree of vacuum in the chamber 103 is increased, compressed air is fed to the actuators 132, so that a seal bar 135 connected to the piston rods of the actuators 132 is lowered to press the opening edge of the packaging bag 130 between it and a seal block 136 fixed on the upper surface of the disk 121, thereby sealing said opening edge. When the chamber 103 arrives above the carry-out conveyor 107 and stops there, air is drawn through an air suction hole 137 formed in the fixed disk 123 into the chamber 103. As a result, the disk 121 is separated from the chamber 103 and drops down onto the carry-out conveyor 107; the packaged product 140, together with the disk 121, is carried out of the system by the carry-out conveyor 107.

In FIG. 5, the oval arrow shows the rotary circular path 139 for the chambers 103. Disks 121 being carried by the conveyor 106 are successively attracted to the lower open surfaces of the chambers 103 to close the successive chambers 103. During the time each disk 121 is moved integrally with the chamber 103 along the circular path 139, a vacuum is applied to the article in the chamber 103. Thereafter, the disk 121 and the packaged product 140 are transferred from the chamber 103 onto the carry-out conveyor 107.

What is claimed is:

1. An apparatus for vacuum-packaging bags containing articles therein, comprising a rotor rotatable in a vertical plane around a horizontal axis, a plurality of open-and-close type chambers supported at regular intervals along the periphery of said rotor for movement in a rotary circular path as said rotor rotates, means for opening and closing said chambers air-tightly when in the lower region of said rotary circular path, means for storing a packaging bag, formed with an opening edge and filled with an article therein, in each chamber insertable therein when said chamber is open, means for applying and removing a vacuum in each chamber, means for sealing the opening edge of the packaging bag while in the chamber, and means for removing the packaged article from the chamber when the latter returns to the lower region of the rotary circular path and is opened and the vacuum therein removed, characterized in that each chamber is rotatably supported by said rotor and suspended in a vertical position at all times during movement of said chambers by said rotor around said horizontal axis.

2. An apparatus as set forth in claim 1, wherein:

each chamber is of inverted cup-shape with the bottom open, and the chambers are adapted to be stopped at a position in the lower region of the circular path for the chambers, said apparatus further including;

said disks capable of supporting packaging bags filled with articles and attracted to the chambers by evacuating the chambers when said disks are pressed against the open bottom of the chambers, means for feeding the disks to a location below the chamber stopping position, and means for raising the disks when fed to said location below the chamber stopping position, to the open bottom in the chamber.

3. An apparatus as set forth in claim 1, including:

carry-out means positioned below a location to which, when a chamber is stopped above the feeding means, another chamber which has completed its travel along the rotary circular path has moved, said carry-out means being adapted to receive a disk which falls as it is separated from the chamber by the removal of the vacuum condition in said another chamber.

4. An apparatus as set forth in claim 1, wherein:

the chambers are rotatably suspended from the rotor by pins, each pin having a hollow portion which is communicated by the interior of the chamber, and said apparatus has pipe means disposed with one end thereof coaxial with said pin and communicating with the interior of the chamber through the pin, the other end of said pipe means being capable of communicating with a vacuum source.

* * * * *